United States Patent [19]

Auclair et al.

[11] 4,255,125

[45] Mar. 10, 1981

[54] MIXING APPARATUS AND THE USES THEREOF

[75] Inventors: Michel Auclair; Louis Le Parmentier, both of Mont-Saint-Aignan, France

[73] Assignee: Exxon Research & Engineering Co., Florham Park, N.J.

[21] Appl. No.: 969,807

[22] Filed: Dec. 15, 1978

Related U.S. Application Data

[63] Continuation of Ser. No. 757,390, Jan. 6, 1977, abandoned, which is a continuation-in-part of Ser. No. 525,076, Nov. 19, 1974, abandoned.

[51] Int. Cl.[3] ..... F23D 13/40

[52] U.S. Cl. ..... 431/354; 239/402; 239/466

[58] Field of Search ..... 239/8, 402, 404, 405, 239/434.5, 466, 383, 400; 431/2, 8, 9, 183, 35 4

[56] References Cited

U.S. PATENT DOCUMENTS

| | | | |
|---|---|---|---|
| 893,833 | 7/1908 | Beckman | 239/402 X |
| 1,503,817 | 8/1924 | Compere | 239/383 |
| 2,358,386 | 9/1944 | Doll | 239/402 X |

FOREIGN PATENT DOCUMENTS

| | | | |
|---|---|---|---|
| 131175 | 8/1919 | United Kingdom | 239/402 |

*Primary Examiner*—Edward G. Favors
*Attorney, Agent, or Firm*—F. Donald Paris

[57] ABSTRACT

A process and apparatus for use in atomizing a combustible material into a form for improved combustion comprising (i) an atomization zone, (ii) an ante-chamber connecting with the atomization zone, (iii) at least two feed inlets to the ante-chamber at least one being for said combustible material and at least one other for an auxiliry atomizing gas, and (iv) means (e.g. a mixing vane) at or in the immediate vicinity of the exit of the atomization zone for modifying the profile of atomized material exiting from the zone; and in which apparatus the atomization zone is of generally cylindrical cross-section and is provided internally with means which are adapted to impart to the streams of the combustible material and atomizing gas passing therethrough multiple shearing action and changes of rotational direction. Substantially no atomization of the fuel by the auxiliary gas occurs prior to entry into the atomization zone.

5 Claims, 9 Drawing Figures

MIXING APPARATUS AND THE USES THEREOF

CROSS REFERENCE TO RELATED APPLICATIONS

This is a continuation of application Ser. No. 757,390 filed Jan. 6, 1977, now abandoned, which is a continuation-in-part of application Ser. No. 525,076 filed Nov. 19, 1974 and now abandoned.

Copending U.S. application Ser. No. 525,075 filed Nov. 19, 1974 and assigned to the assignee of the present invention, relates to another mixing apparatus and method.

BACKGROUND OF THE INVENTION

This invention relates to the atomisation of certain combustible materials and also to their combustion thereafter.

The combustible materials envisaged in this invention are materials which are, or at a temperature up to 300° C. are, a gas, a liquid, a particulate solid or a liquid containing particulate solids, and are, or at said temperature are, pumpable or flowable.

Such materials, for example gaseous or liquid fuels, only burn completely if they are mixed with a gas containing oxygen. Liquid fuel burners include essentially an atomiser. This atomiser is generally accommodated in the burner head, which is mounted at the extremity of the body or tube of the burner. The burner forms an integral part of a more or less complicated apparatus which includes suitable means for mixing the atomised fuel with a gas containing oxygen and for producing the desired flame.

Known burners make use of three atomising processes, atomising by an auxiliary fluid, mechanical atomising by the pressure of the fuel and atomising by rotating cup. Some burners embody a combination of these processes.

Atomising by an auxiliary gas uses the energy liberated by the expansion of compressed air or vapour under pressure for dispersing the fuel. This dispersion is produced by the meeting of a jet of liquid fuel and a jet of the auxiliary gas. The atomising obtained by this process is very coarse, above all in the case of the more viscous fuels. Moreover, the consumption of auxiliary fluid is quite considerable, generally in excess of 10 kg vapour to 100 kg heavy fuel oil. Consumptions of 15 to 20 kg vapour per 100 kg heavy fuel oil are normal.

In a burner with mechanical atomising by pressure, the fuel is injected tangentially into a cavity within which it performs a rapid rotary movement, while moving towards the orifice of the burner. This orifice is arranged in the center of a cap which covers the cavity and constitutes the burner jet. At the outlet of the jet or nozzle, the jet of liquid is in the form of a conical sheet. This type of atomiser only allows very limited variation in delivery. Various improvements, in particular the heavy oil return burner and the double feed burner, allow somewhat greater flexibility in operation; but these burners and their supply circuit are complex. All the mechanical atomising burners produce droplets which are larger the more viscous the fuel. The size of the drops also increases with the delivery. The nozzle, which is exposed to the radiation of the flame and the furnace, is frequently obstructed by the formation of coke.

Rotating cup burners are far less used than the previous ones. The cup, which is driven by compressed air or an electric motor, atomises the fuel by centrifuging.

If the problems inherent in the use of liquid fuels, such as heavy fuel oils, have found satisfactory solutions from a technical point of view whereas from an economic point of view these solutions are not free from imperfections, the same cannot be said of the problems raised by the combustion of by-products that very much more viscous than the usual fuel oils contain suspended solid constituents. For instance, it is not possible with any known burner to atomise certain tars and make them burn properly. Either the burner is obstructed too quickly, or the atomising of the fuel is far too coarse.

The present invention has as one object the overcoming of this problem whereby it is possible to burn fuels of very different kinds, only requiring a moderate consumption of auxiliary fluid and having great flexibility of operation as regards both the delivery of the fuel and its physical state.

In prior proposals for atomising by an auxiliary gas, the energy released by the expansion of the latter is first of all used to form a jet of gas in which this energy is converted into kinetic energy. Next, in the impact produced between the jet of gas and the jet of liquid fuel, a fraction of the kinetic energy of the two jets is used to overcome the forces of cohesion of the liquid. The efficiency of this process is poor for the mere impact of the jets only makes it possible to use a small fraction of the kinetic energy of the fluids to bring about the dispersion of the liquid. In other prior proposals, the initial jet of the auxiliary gas is produced by only a partial expansion of this gas and the mixture formed by the meeting of the two jets undergoes a further partial expansion or expansions, by passing through a narrow passage or several successive narrow passages, in which fresh divisions of the liquid drops are produced through shearing stresses. However, the greater part of the energy liberated under these conditions by the expansion of the gas is dissipated in heat, so that with burners that are thus improved, the consumption of auxiliary gas remains very considerable. Moreover, highly viscous fuels rapidly choke this type of burner.

SUMMARY OF THE INVENTION

According to the present invention, a process for the atomisation of a said combustible material process comprises the steps of (a) feeding at least one stream of a said combustible material and at least one stream of an auxiliary gas, under pressure, through an elongated zone in which atomisation of the combustible material is achieved by expansion of the auxiliary gas whilst causing the said streams frequently to split into partial streams, recombine and change rotational motion of flow throughout substantially the whole of the zone, and (b) adjusting the feed of the said auxiliary gas and combustible material into the atomisation zone such that the atomised produce from the zone is one in which the axuiliary gas occupies an appreciably greater volume than that occupied by the combustible material.

This process make it possible, for example, to obtain a very fine dispersion of the liquid fuel. In this form, the stream of fuel can be mixed very intimately with a stream of oxygen or gas containing oxygen. The result of this is that the formation of unburnt matter can be greatly reduced or even avoided.

There is no critical limit determining the minimum value of this ratio. The energy needed to disperse and propel a given delivery of liquid fuel is furnished by the expansion of the auxiliary gas inside the atomiser; it is equally possible to use a relatively small supply of auxiliary gas by injecting it at high pressure into an atomiser offering high resistance to the flow of fluids as it is on the other hand to use a larger delivery of auxiliary gas injected at lower pressure into an atomiser offering less resistance to the flow of fluids.

For a given delivery of fuel however, too small a supply or auxiliary gas, even at initial pressure which is increased proportionately, may lead either to the production of an emulsion in which the gas is in the dispersed phase, or to the production of a mixed emulsion; in either case, this can lead to the production of an emulsion which does not mix satisfactorily with the gas containing oxygen. As a general rule it is possible to obtain the results aimed at by the invention by using deliveries of auxiliary gas and fuel whose ratio is such that the volume occupied by the gas at the outlet of the mixer is at least 20 to 30 times greater than that of the liquid, provided that the gas pressure at the inlet of the atomiser is sufficient.

The delivery of liquid fuel can be indefinitely small in relation to that of the auxiliary gas. Indeed one of the advantages of the process is that the delivery of fuel can be reduced and made to approach zero, while maintaining constant the appropriate pressure and therefore the delivery of gas to the atomiser inlet. The atomising of a very small delivery of the fuel is excellent, and if the auxiliary gas is compressed air, subsequent combustion of the atomised fuel is very satisfactory.

In principle, there is no maximum or minimum limit as regards the pressures that can be used at the inlet of the atomiser. Indeed, the necessary pressure is linked, as has been explained above, to the delivery of gas and to the characteristics of the mixer. To atomise a given delivery of fuel, it is possible to use a pressure of about 2 bars, or even less, at the inlet of the atomiser, provided that a rather large supply of auxiliary gas is used, with an atomiser offering moderate resistance to the flow of the fluids. In practice, pressures higher than 3 bars, and for preference higher than 5 bars, make it possible to atomise the fuel, using reasonable deliveries of auxiliary air. There is no upper limit as regards the pressures that can be used, but since the delivery of gas has to remain sufficiently high in relation to that of the fuel, there is no point in using extremely high pressures. It is therefore reasonably possible to use a pressure between 3 and 20 bars. For preference, the auxiliary gas is taken to the atomiser inlet at a pressure of 5 to 10 bars.

Typically with a preferred minimum fuel oil pressure of 15 bars (220 psi) the steam pressure is in a range of between about 8.5 to 10 bars (125 to 145 psi), and a fuel oil temperature is 130° C. (265° F.) minimum. Steam pressure as low as 7.5 bars (110 psi), however, is also contemplated.

For example, in order to burn a fuel that is as viscous, and even more so, a heavy fuel oil, it can be atomised by using a delivery of auxiliary gas such that the volume occupied by the gas at the outlet of the mixer is about 60 times as great as the volume of the liquid and by injecting the fuel and the auxiliary gas at a pressure of about 6 bars at the inlet of the appropriate atomiser, such as one described hereafter, this atomiser delivering to a furnace at atmospheric pressure.

The auxiliary fluid is a gaseous substance at the pressure and temperature at which it is used. The auxiliary gas is for preference compressed air or steam under pressure, but many other gases can be used. In particular, a fuel gas such as methane can be employed. Very low quantities can be used. For example, as little as 2 to 3 kg steam to atomise 100 kg heavy fuel oil.

For preference, the pressure of the auxiliary gas at the inlet to the atomiser, and therefore its delivery, are largely constant. It is then possible to alter the delivery of fuel by merely acting on its pressure at the inlet. The process makes it possible to vary within hitherto unequalled proportions the delivery of atomised gas.

The invention makes it possible to use several combustible materials simultaneously or otherwise, with the same apparatus. It is understood that the combustible material can be heterogeneous and that it can contain in suspension insoluble solid particles. An example of particulate solids is pulverised coal. A slurry of pulverised coal can also be employed.

An especially useful aspect of the invention lies in its opening up the possibility of using heterogeneous of very viscous materials such as, for example, viscous petroleum by-product tars, such as tars from a petroleum refinery steamcracking process.

Again the invention enables the disposal of sludges containing organic materials. The purification of urban effluents and certain industrial effluents as a rule comprises the separation of sludge containing organic materials. This sludge is eliminated by spreading or incineration. Incineration is performed in special furnaces.

Rotary furnaces are regularly used with staggered combustion, in the upper stages of which the drying of the sludge takes place. Some pyrolysis of the organic materials is unavoidable, and ignition is very gradual. These furnaces give off nauseating smoke, whose purification requires post-combustion.

The use of so-called fluidised bed furnaces is tending to become generalised, especially for the treatment of the waste water from petroleum refineries. These furnaces have a number of advantages. They have no inner partition or machinery. They do not emit gaseous organic compounds and combustion in them is complete. Nevertheless, the operation of an incinerator of this type is delicate, the running costs are quite high and the calorific yield is poor.

The present invention makes it possible to incinerate sludge and makes it possible to burn the organic matter contained in the sludge substantially completely. The invention makes it possible to incinerate pumpable sludges derived from industrial effluent, for instance, or from waste water from papermills, sugar refineries, petroleum refineries, etc. It may be derived from urban effluent. It is thus possible to incinerate the sludge from sewage stations. The sludge can be very wet. Polluted water could even be incinerated directly by this process. It suffices to use a delivery of make-up fuel in relation to the delivery and composition of the sludge. As make-up fuel, a gas or any pumpable liquid can be employed. It is possible to use natural gas, petroleum gas, a liquefied petroleum gas, a heavy fuel oil etc.

In another aspect the invention provides an apparatus for use in the aforesaid atomisation and combustion process, which apparatus comprises in combination (i) an atomisation zone, (ii) an ante-chamber connecting with the atomisation zone, (iii) at least two feed inlets to the ante-chamber, at least one being for a said combustible material, at least one other for a said auxiliary gas, and (iv) means at or in the immediate vicinity of the exit of the atomisation zone for modifying, in use, the profile of atomised material exiting from the zone; and in which apparatus the atomisation zone is of generally cylindrical cross-section and is provided internally with means which, by use of the apparatus, are adapted to impart to stream of fluids multiple shearing action and changes of rotational direction.

An essential feature for the effective operation of the present invention is that there be no, or at the most substantially no, atomization of the fuel by steam or other auxiliary gases prior to entry into the atomization zone. If atomization did occur prior to entry into the zone, then a relatively coarse atomization, such as obtained in the prior art discussed heretofore, would be the result and subsequent passage through the zone would not appreciably improve the degree of atomization. Thus, it is only when the mixing is substantially completely accomplished in the atomizer that the desired fine atomization is achieved. Other characteristics which are important for obtaining the optimum preferred operation of the present invention are that the fuel oil delivery pressure can be higher than the auxiliary gas delivery pressure. Essentially all of the pressure drop is taken through the atomizer zone which provides more energy from each pound of auxiliary gas to shatter the fuel oil into small droplets. Since firing rate is regulated as a function of pressure difference between the fuel and auxiliary gas, the fuel must be delivered to the burner gun at pressure levels in excess of auxiliary gas pressure. Another preferred characteristic is that fuel be delivered from the central nozzle with the auxiliary gas, e.g., steam surrounding it. Finally, when steam is employed as the auxiliary gas, the temperature of the fuel should be close to that of the steam in order to avoid too much condensation of the steam. An excess of condensation means that less energy is available for subsequent atomization duty in the atomization zone (i.e., the energy attributable to the condensed portion is lost). This can be overcome, however, by increasing steam delivery pressure, which may be necessary if lower boiling fuels are employed.

The preferred form of the atomisation zone or chamber is one employing one of the known motionless or stationary blenders or mixers, that is to say of the type consisting of a cylindrical tube in which are inserted appropriate fixed devices which have the effect of imparting to the fluids passing through the tube multiple shearings and changes of direction. A typical stationary mixer device and application therefore are described in U.S. Pat. No. 3,286,992 to Armeniades, and in U.S. Pat. No. 3,704,006, to Grout et al.

The mixer may consist in particular of a tube in which a packing is inserted. This packing may consist of a stack of elements of suitable shape. Or again, the mixer may consist of a cylindrical tube in which a series of spirals or stationary helicoidal components are inserted. Thus a preferred form of atomisation zone containing a succession of curved elements or vanes whose shape and arrangement are defined as follows:

(a) the width of each vane is very largely equal to the inner diameter of the zone and the length of each vane is at least equal to 1.25 times the inner diameter of the zone, (b) each vane is curved so as to impart in use, to the fluids passing through the zone, a rotary movement in relation to the axis of the zone, (c) the shape of each vane is that which is obtained from a rectangular plate whose width is equal to the inner diameter of the tube, by twisting this plate so as to rotate the short sides in relation to one another by a certain angle about the greater median, (d) the long sides of each vane bear in the inner surface of the tube and each vane divides in two the transverse section of the tube, (e) the vanes are oriented in such a way that the leading edge of each vane, except for the first vane above the mixer, forms an angle with the trailing edge of the preceding vane, and (f) the vanes are fixed in the zone by any suitable means.

It is preferred that:

(a) the length of each vane is between 1.3 and 3 times the inner diameter of the zone, (b) the angle formed between them by the leading edge and the trailing edge of each vane is between 120° C. and 240° C., (c) some vanes are curved in one direction and alternate with vanes curved in the opposite direction, in largely equal numbers, and total between 5 and 30 vanes, (d) the leading edge of each vane, except for the first vane upstream, is in contact and forms an angle of 90° with the trailing edge of the preceding vane.

The atomisation zone may contain from 5 to 30 vanes. For preference it contains between 10 and 20.

The vanes can be fixed at a certain distance from one another. For preference the leading edge of each vane, except for the first vane above the mixer, is in contact and forms an angle that is not zero with the trailing edge of the previous vane. This angle can, for instance, be between 30° and 150°. For preference it is about 90°.

Use is made for preference of a static mixer having largely equal numbers of vanes that are curved in both directions. The vanes of both types can be distributed at random. For preference they are arranged in equal groups, the groups of vanes curved in one direction alternating with groups of vanes curved in the other direction.

Special preference is given to the following arrangement: the angle of twist of each vane is about 180°; the adjoining vanes are twisted in opposite directions; they touch one another, and the edges in contact form an angle of about 90°.

For preference, the vanes are fixed to one another by their points of contact. This fixing can take place in particular by soldering, welding or brazing. The vanes thus assembled can be kept stationary in the tube by any suitable means. For preference, the lateral edges of the first vane above the tube are welded/soldered or brazed inside a ring which has the same inner diameter as the tube and is supported on an extremity of the latter. This form of assembly makes it possible to take the mixer apart and replace the vanes.

Any skilled technician will be able to calculate the characteristics of the mixer to be used whatever its type, in particular the inner diameter of the tube, the length of tube occupied by the fixed devices inserted therein, etc. in relation to the delivery and initial pressure of the auxiliary gas, as has been fully explained above, so that the mixer opposes the flow of that gas with the appropriate resistance.

Certain static mixers impart a rotary movement to the stream of fluids passing through the tube. If the gyratory component of the stream in the tube, below the last element of the mixer, is considerable, the speed of the droplets at the outlet from the tube may have a transverse component such that the angle of opening of the jet is ill-adapted to the shape or aerodynamic characteristics of the furnace. In such a case, it is desirable for suitable means to be inserted in the tube immediately below the last element of the mixer, to reduce or cancel out the gyratory component of the current. These means may consist in particular of a curved element or vane, having a curve and a length such that it imparts to the fluids the necessary impetus for reducing or cancelling the gyratory component of the stream. For example, if the mixer comprises a succession of adjoining vanes, in which two consecutive vanes are twisted in the opposite directions, this mixer can be modified by docking the last vane of about a quarter of its length; the gyratory component of the current below the last vane of the mixer thus modified is virtually nil.

It is preferred that the curved elements or vanes are inserted forcibly in the tube and the last vane downstream of the tube rests on a nozzle forming one part with the latter.

This method of assembly has several advantages. The vanes are not expelled from the tube if a weld has given way. The vanes, in particular the last one downstream, are perfectly stationary and this avoids the need for welding them to the tube. It is easily possibly to replace the vanes in the event of damage.

The nozzle is attached to the exist of the mixers, and gives the desired profile to the jet of atomised fuel, and therefore to the flame when the atomised fuel is subsequently burnt.

This nozzle may comprise one or more cylindrical or conical holes. The diameter of the holes is sufficiently large for the stream of fluids to undergo only a slight loss of pressure in traversing them.

If the nozzle is a single cylindrical apertured nozzle then its diameter is suitably between 0.5 to 0.9, preferably 0.6 to 0.8 of the internal diameter of the atomisation zone. Where a plurality of holes are provided in the nozzle, they are suitably arranged to provide a conically-profiled jet.

The effect of the nozzle gives the jet of atomised fuel and auxiliary gas the desired profile. It also greatly improves the homogeneity of the distribution of the fuel in the auxiliary gas. This result was in no way foreseeable. Finally the nozzle is advantageously used as a stop for retaining the curved elements in the atomisation tube.

The stream of fluids undergoes a loss of pressure in traversing the atomiser and it sustains a further loss in traversing the nozzle. According to a preferential characteristic of the invention, the atomiser and the nozzle acts in conjunction in such a way that the loss of pressure through the nozzle is relatively slight. For preference, the mixer and the nozzle are calculated so that the loss of pressure through the nozzle is less than 80%, or better still, less than 50% of the total loss of pressure.

The rate of flow in the fluids in the atomiser exerts a decisive influence on the atomising of the fuel. The atomiser is calculated so that with the desired deliveries, the flow of the fluids is very turbulent.

According to a preferred form of carrying out the present invention, the characteristics of the atomiser, in particular the inner diameter of the tube and the length occupied by the parts inserted in it, are calculated so that the auxiliary gas undergoes a loss of pressure exceeding 3 bars, for preference between 5 and 20 bars, between the inlet and the outlet of the atomiser, the delivery of auxiliary gas being such that it occupies after expansion, at the outlet of the nozzle, a volume of at least 30 times, or for preference 50 to 150 times, greater than that of the liquids admitted to the burner operating at its maximum output. For preference, the characteristics of the atomiser are also calculated so that under the conditions of pressure and delivery thus defined, the rate of flow of the fluids at the inlet to the atomiser is higher than 10 meters second, or better still, than 25 meters/second.

In all cases it is necessary to have as little dead space as possible downstream of the last element in the atomisation zone, to prevent coalescence of atomised droplets. Hence the shorted last curved element is at the exit to the chamber; or the last full element abuts the nozzle.

BRIEF DESCRIPTION OF THE DRAWINGS

Some embodiments of apparatus for use in atomisation and combustion process of the invention will now be described, by way of non-limitative examples, reference being made to the accompanying drawings in which:

FIG. 8 shows oil gun operating characteristics; and

FIG. 9 shows atomizing steam consumption for a conventional gun and one according to the present invention.

DESCRIPTION OF THE PREFERRED EMBODIMENTS

The present invention basically employs a motionless mixing device in order to achieve a relatively high degree of fuel atomization from a relatively small amount of steam. In contrast to conventional atomizers, the auxiliary gas, e.g., steam, and fuel oil are delivered to the mixing zone at a relatively high pressure with substantially all of the pressure drop being taken through the atomizer. This effectively provides more energy from each pound of steam in order to perform the atomization of the fuel.

Figure 1:
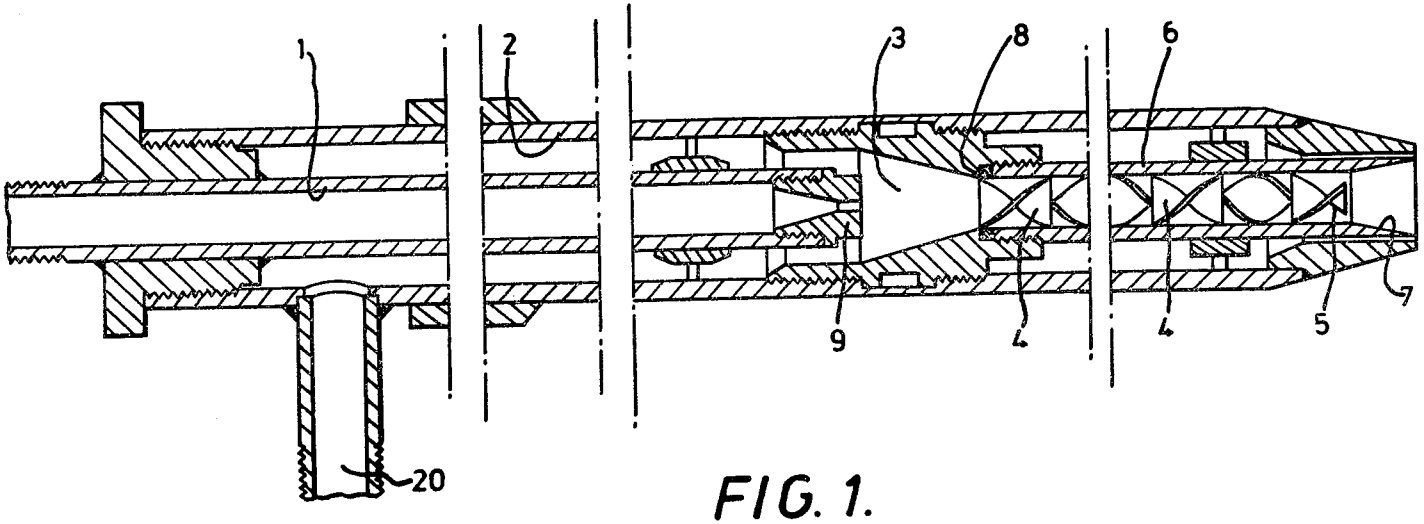
FIG. 1 shows one device in longitudinal cross section.

Referring to FIG. 1, the device comprises an inner feed tube 1, leading through an injecting orifice 9 into ante-chamber 3. A concentric tube 2, having inlet 20, also leads to the chamber 3. Chamber 3 leads to an atomisation zone comprising a tube 6 in which are housed fifteen curved elements 4 and one partial such element 5. The tube 6 has an internal diameter of 14 mm. The elements 4 are each of an appropriate length, for example, 20 mm long, and twist through an angle of 180°, alternately in left hand and right hand direction. The elements make close fit with the wall of tube 6 and the elements are brazed or otherwise secured to each other at their points of contact (at which point the contacting edges are at about 90° to each other). A slot can be provided at the end of each element for interlocking with a corresponding slot in an adjacent element.

The first of elements 4 is secured to a ring 8 secured to tube 6. The final element 5 is of reduced length, being about three-quarters that of elements 4, giving an angle of twist of about 135°.

The extremity of tube 6 is conically shaped to enable a conical spray to be obtained.

Figure 2:
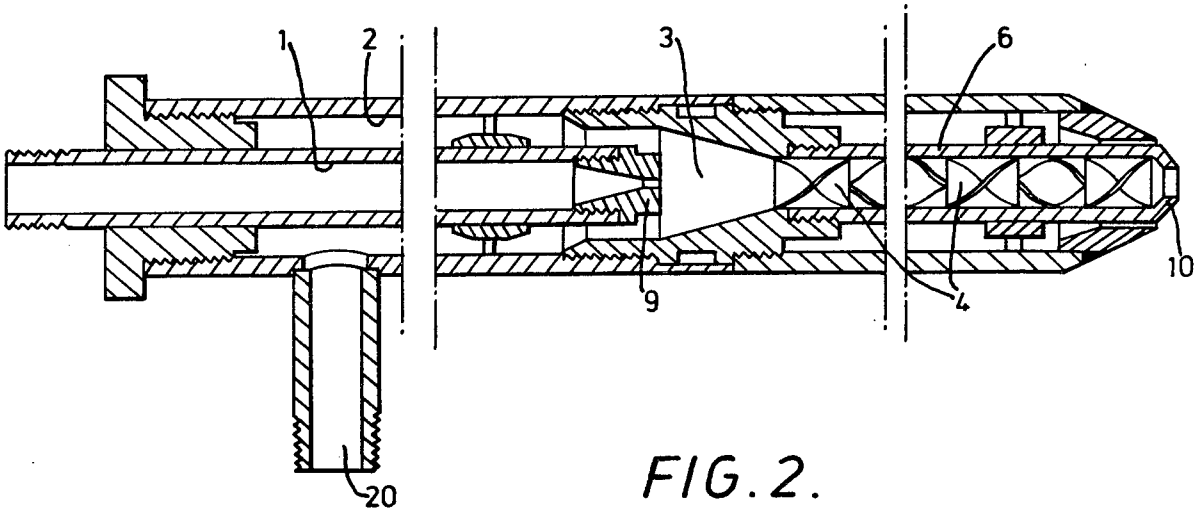
FIG. 2 shows another device in longitudinal cross section.

Referring to FIG. 2, the basic construction is very similar to that in FIG. 1, like parts being given like reference numerals. A modification occ however, at the exit portion of atomisation zone 6. The elements 4 termina with a full element and not the shortened element 5. The extremity of tube is formed into a nozzle 10 which acts to determine the shape of the spray issuing from the zone and acts to retain elements 4 in the tube should they for any reason start to be ejected. The nozzle outlet 10 is for both these reasons located in the immediate vicinity of the final element 4. A typical arrangement can include eighteen elements of 16 mm length, with a total element length of about 270 mm, which takes into account interlocked slots of the elements. Other variations in the number and length of the elements individually and collectively are also within the contemplation of the invention.

Figure 3:
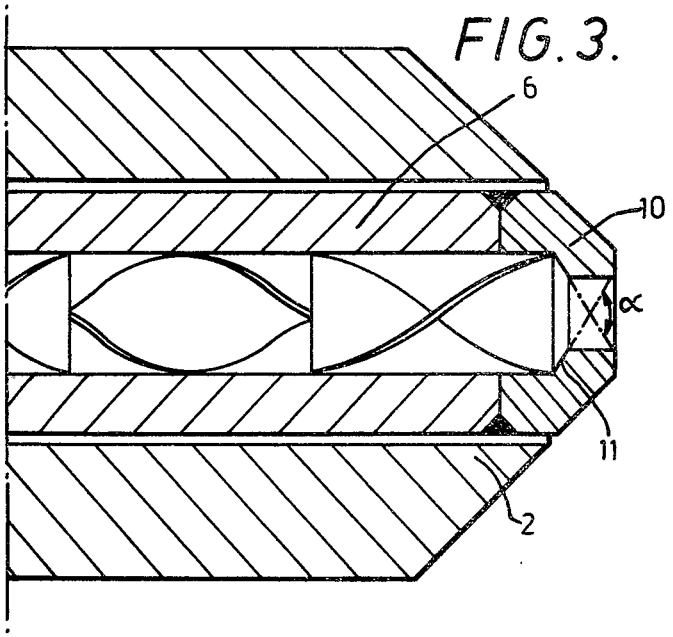
FIGS. 3 and 4 show modifications of the outlet from the device shown in FIG. 2.

In FIG. 3 the nozzle 10 is a member secured to the end of tube 6. The nozzle has a truncated conical inner profile of angle alpha between 60° and 120°.

Figure 4:
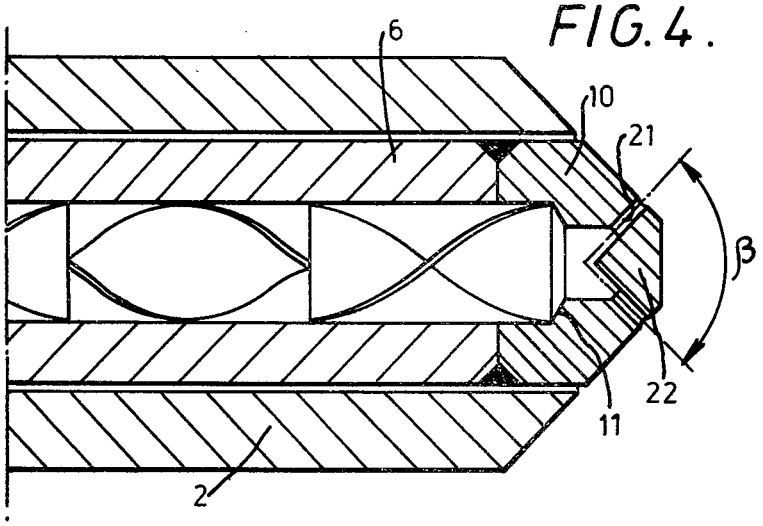

In FIG. 4 the nozzle 10 has several cylindrical apertures 21 distributed in a conical manner to give a spray of a conical shape of included angle beta. Preferably, to avoid dead space, the nozzle 10 has an inwardly projection portion 22.

Figure 5:
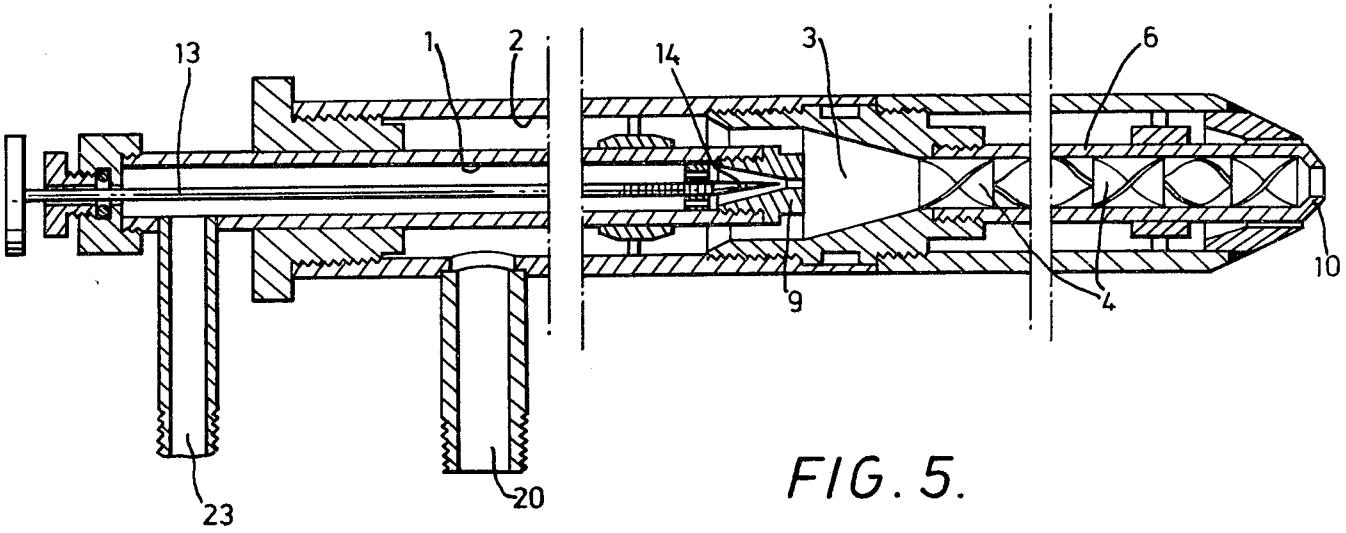
FIG. 5 shows a modification for varying the injection orifice of the device of FIG. 2.

With reference to FIG. 5, the apparatus can be provided with means for varying the injection orifice 9. This means comprises needle valve rod 13, 14, movable into and from a corresponding seating in the orifice 9.

Figure 6:
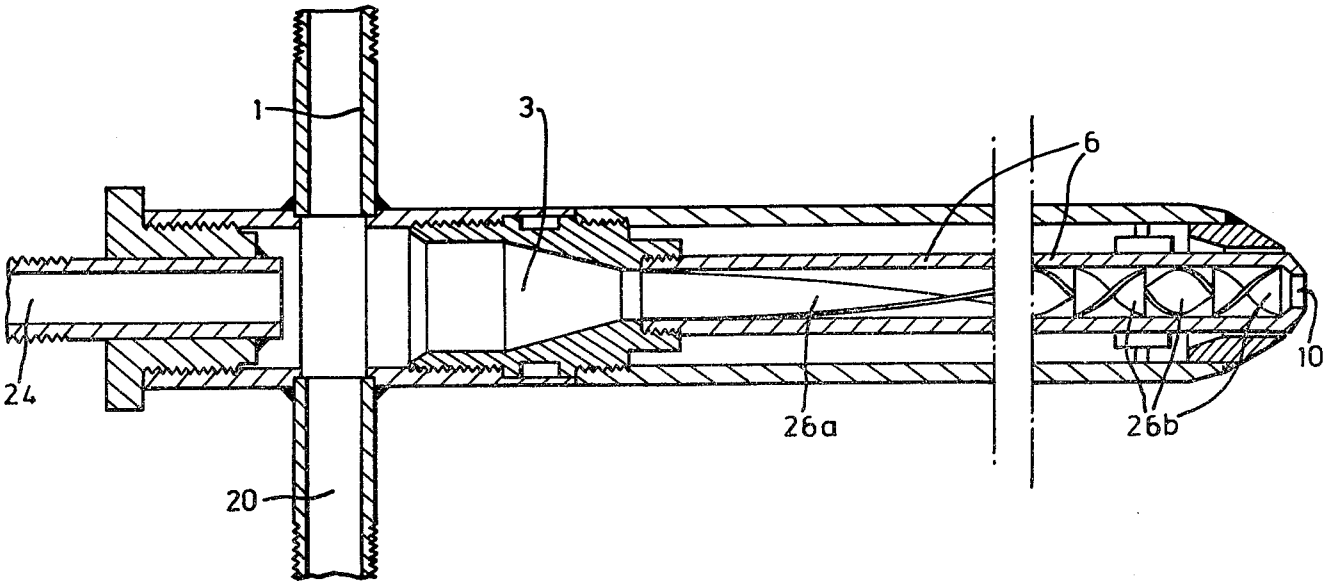
FIG. 6 shows further modifications of the device of FIG. 2.

Finally, referring to FIG. 6, modifications are made to provide further feed inlets such as 24. Furthermore, for use in atomising certain combustible materials, the curved elements 4 are replaced by a first set **26*a* each element of which is of length about ten times that of those in the immediately following set 26*b***.

According to this invention, the pressure of the auxiliary gas such as steam is maintained constant preferably in the range of substantially 8.5 to about 10 bars (125 to 145 psi). The fuel oil passes through an orifice directly into the relatively high pressure steam. This mixture then flows into and through the atomizer. FIG. 8 illustrates an example of the difference in the fuel oil pressure flow characteristics between a conventional oil gun (designated A) and one according to the present invention (designated B). Since according to this invention substantially all of the pressure drop is taken in the atomizer section which contains the motionless mixer, the atomizer can be designed with flow passages of relatively large diameter, thus making it possible to atomize relatively heavy fuel oil such as sludges, incinceration, etc., with a relatively small amount of steam. Those larger passages are not inclined to plugging. Because this is accomplished at relatively high pressures, theoretically a greater amount of kinetic energy is available to break the liquid fuel into small droplets. In a conventional gun steam and fuel oil enter and pass through concentric pipes into a properly sized orifice. The atomization is accomplished in the region immediately upstream of the gun tip. This type of gun is normally operated with atomizing steam pressure at a fixed pressure differential relative to fuel oil pressure (e.g. on the order of 1.4 bars or 20 psi), with a steam pressure being greater as shown by B in FIG. 8. Thus, an increase in fuel flowrate results in a corresponding increase in steam flowrate and consequently, steam consumption.

The atomizing steam consumption of a gun according to the present invention is primarily governed by a number of factors. These include tip dimensions, atomizer geometry and fuel flow rate, fuel oil temperature. The factor exerted by the fuel oil temperature is that if it is slightly colder than that of the steam, which is usually the case, then some of the steam will condense in the atomizer which will create a decrease in pressure drop through the mixer and an increase in the steam flow. When the fuel oil temperature is equal to or greater than that of the steam, then steam consumption will be minimized. Use with relatively cold fuels, however, results in too much condensation and steam usage.

In a conventional atomizer compared to one according to the present invention, the latter employs on the order of 50 to 80% less steam. FIG. 9 illustrates a typical comparison between atomizing steam requirements for a conventional atomizer and one according to the present invention. These atomizers comprises 2.9 mw (10 btu/hr) guns. The consumption of the conventional gun is shown by the line C, while that of the present invention is illustrated by the line D. As shown for the present atomizer, steam consumption decreases as fuel rate increases, in contrast to the conventional atomizer wherein steam rate increases with increased fuel rate. This is because in the present invention the atomisation and pressure drop takes place substantially wholly in the mixer, and increased pressure drop and atomization intensity becomes mainly due to the fuel oil and not the steam or other auxiliary gas.

In accordance with this invention the flow rate of the fuel is generally proportional to the square root of the pressure differential between fuel (e.g., oil) and auxiliary gas (e.g. steam).

The following examples illustrate, in non-limitative manner, processes in accordance with the invention.

EXAMPLE 1

An apparatus as described with reference to FIG. 1 was employed. The combustible material used was a hydrocarbon tar having the following characteristics:

| | | | |
|---|---|---|---|
| Density at 15° C. | 1.131 | Heptane-insoluble | 17.5% |
| Viscosity at 50° C. | 975 cst | Hexane-insoluble | 43.2% |
| Viscosity at 100° C. | 31 cst | Carbon | 87.8% |
| Residual carbon (Conradson method) | 20.5% | Hydrogen | 7.1% |
| | | Sulphur | 5.1% |

The tar was preheated to 140° C. and fed at 8 to 15 bars pressure at a rate of from 400 to 900 kg/hour. The auxiliary gas was steam at constant pressure of 6 bars and feed rate 30 kg/hour.

Upon issuing from the atomisation zone the atomised product was burnt in an industrial furnace. A white flame was produced with no offensive smoke.

This is a major advance since previously it has not been possible to burn this type of hydrocarbon tar without producing black smoke.

Figure 7:
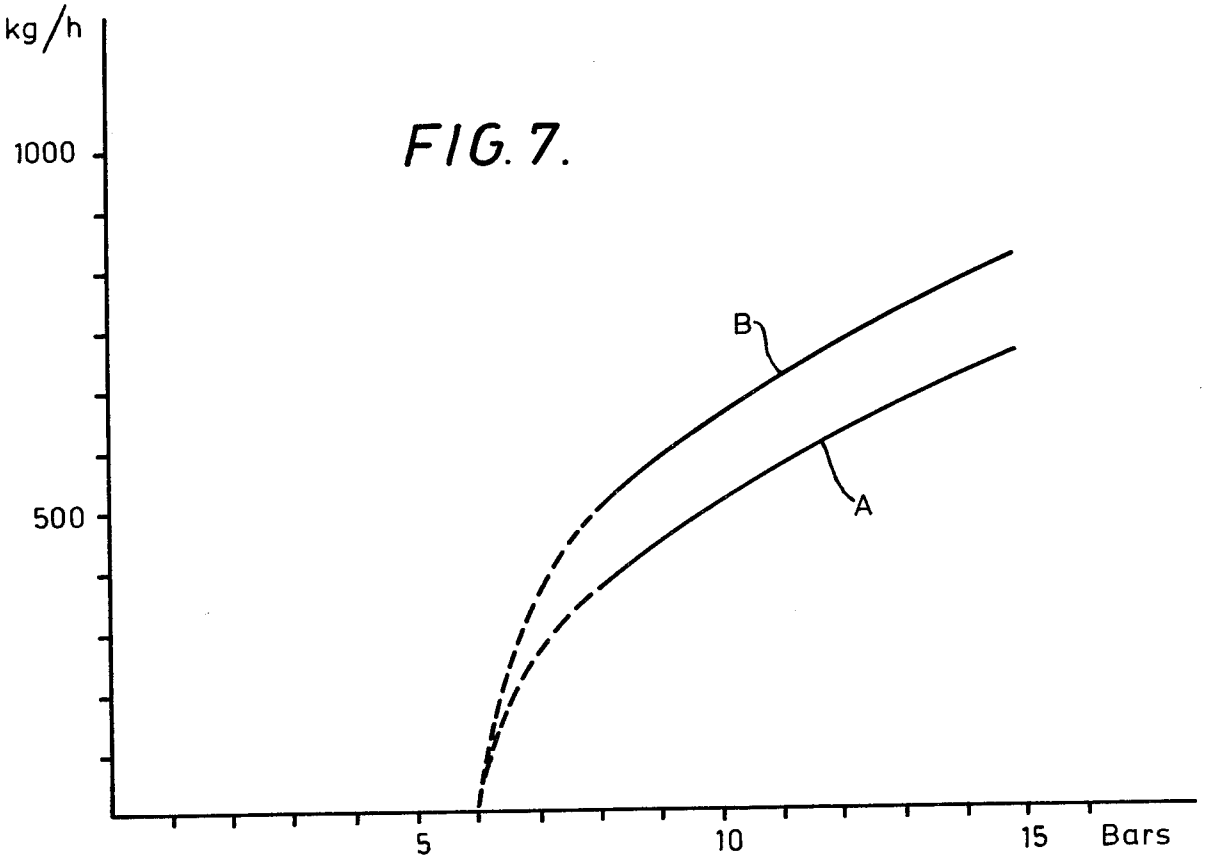
FIG. 7 shows tar supply as a function of its pressure above the burner.

FIG. 7 of the attached drawings is a graph showing the supply of tar as a function of its pressure above the burner.

The tar pressure, measured upstream of the tube 1 in bars, is plotted as abscissa. The corresponding supply of tar, in Mg/h, is plotted as ordinate.

The steam pressure, measured upstream of the tube 2 is constant and equal to 6 bars.

In this figure, curve A represents the tar deliveries that are obtained with a device according to the invention provided with an injection orifice 9 whose diameter is 2.5 mm. Curve B represents those which are obtained when the diameter is 3.5 mm.

An attempt was made to burn the same tar under the same conditions, but using injection of the usual type, with atomising by an auxiliary fluid. This usual type was identical with that which is represented in FIG. 1, except that no device was inserted in the tube 6; the orifice 9 had a diameter of 2.5 mm. Atomising was faulty and the flame obtained emitted black smoke whatever the pressure and delivery of the tar and the steam above the burner.

EXAMPLE 2

An apparatus was used, as represented in the attached FIG. 6, for incinerating in a furnace sludge derived from the waste liquor of a petroleum refinery.

The tube 6 has a length of 3.90 m and an inner diameter of 14 mm. In this tube there was inserted a series of 18 curved elements 26*a* 200 mm long, and a series of fifteen curved elements 26*b* 20 mm long. The leading and trailing edges of each formed an angle of 180°. Elements twisted in one rotational direction alternated with those twisted in the opposite rotational direction.

By means of this apparatus a sludge was atomised (and thereafter burnt) derived from the residual liquor of a petroleum refinery. This sludge contained 65% water, 28% organic material and 7% solid particles. It was fed into tube 1. A make-up fuel was used, being a heavy fuel oil having a viscosity of 200 cst at 50° C. The fuel oil was preheated to 140° C., and was fed into tube 1.

To ensure that the atomising and the propulsion of the sludge and the fuel oil, an auxiliary gas was used being steam at a pressure of 6 bars; being fed into tube 24.

The deliveries were as follows:

700 kg/hour sludge 200 kg/hour fuel oil 50 kg/h steam

The combustion of the fuel oil and the organic materials contained in the sludge was complete.

EXAMPLE 3

The same operation was used for incinerating a sludge which contained 20% water, 70% liquid organic material and 10% solid particles. This sludge, like that of Example 2, came from the waste liquor of an oil refinery.

An auxiliary gas was steam at a pressure of 6 bars.

The deliveries were as follows:

700 kg/hour sludge 50 kg/hour steam

No make-up fuel was needed. The sludge burnt completely,

What is claimed is:

1. Apparatus for use in the atomization of combustible materials, comprising in combination:

(a) an atomization zone having an inlet and an outlet end, said zone being cylindrical in shape and having a uniform cross-section;

(b) a chamber connected adjacent said inlet end of said atomization zone and including a cross-section greater than said cross-section of said zone;

(c) a first inlet for said chamber for feeding combustible material therein and a second inlet for said chamber for feeding an auxiliary gas therein;

(d) means adjacent said outlet end of said atomization zone for modifying the profile of atomized combustible material which exits therefrom; and (e) mixing means internally secured in said atomization zone for the length thereof for imparting to said combustible material and auxiliary gas flowing therethrough a multiple shearing action and change in rotational direction thereof along the length of said zone, said mixing means comprising a plurality of vanes along the length of said atomization zone having longitudinally spaced opposed to transverse extending edges, with adjacent edges of said vanes being in contact and angularly disposed with respect to each other, and wherein the end one of said vanes adjacent said outlet end of said atomization zone is shorter in length than the remaining ones of said vanes in said atomization zone.

2. Apparatus for use in the atomization of combustible materials, comprising in combination:

(a) an atomization zone having an inlet and an outlet end, said zone being cylindrical in shape and having a uniform cross-section;

(b) a chamber connected adjacent said inlet end of said atomization zone and including a cross-section greater than said cross-section of said zone;

(c) a first inlet for said chamber for feeding combustible material therein and a second inlet for said chamber for feeding an auxiliary gas therein;

(d) means adjacent said outlet end of said atomization zone for modifying the profile of atomized combustible material which exits therefrom; and (e) mixing means internally secured in said atomization zone for the length thereof for imparting to said combustible material and auxiliary gas flowing therethrough a multiple shearing action and change in rotational direction thereof along the length of said zone, said mixing means comprising a plurality of vanes disposed along the length of said atomization zone and adjacent ones of said vanes being disposed in contact with each other, said plurality of vanes comprising first vanes and at least a second vane of a length substantially greater than that of said first vanes.

3. Apparatus for use in the atomization of combustible materials, comprising in combination:

(a) an atomization zone having an inlet and an outlet end, said zone being cylindrical in shape and having a uniform cross-section;

(b) a chamber having a tapered configuration in the longitudinal direction connected adjacent said inlet end of said atomization zone and including a cross-section greater than said cross-section of said atomization zone, first and second inlets for said chamber for feeding combustible material and auxiliary gas therein, respectively, said chamber extending between a said first inlet and said inlet end for said atomization zone with said greater cross-section traversing said first inlet and said taper longitudinally extending inward therefrom to said inlet end of said zone;

(c) means adjacent said outlet end of said atomization zone for modifying the profile of atomized combustible material which exits therefrom; and (d) mixing means internally secured in said atomization zone for the length thereof for imparting to said combustible material and auxiliary gas flowing therethrough a multiple shearing action and change in rotational direction thereof along the length of said zone.

4. Apparatus for use in the atomization of combustible materials, comprising in combination:

(a) an atomization zone having an inlet and an outlet end, said zone being cylindrical in shape and having a uniform cross-section;

(b) a chamber connected adjacent said inlet end of said atomization zone and including a cross-section greater than said cross-section of said zone;

(c) a first inlet for said chamber for feeding combustible material therein and a second inlet for said chamber for feeding an auxiliary gas therein;

(d) means adjacent said outlet end of said atomization zone for modifying the profile of atomized combustible material which exits therefrom; and (e) mixing means internally secured in said atomization zone for the length thereof for imparting to said combustible material and auxiliary gas flowing therethrough a multiple shearing action and change in rotational direction thereof along the length of said zone, said mixing means in said atomization zone comprising a plurality of vanes, each of which has a predetermined shape and configuration, and said profile modifying means comprising one of said vanes located directly adjacent said outlet end of said atomization zone, said one of said vanes being shorter relative to the other of said vanes in said atomization zone.

5. Apparatus according to claim 2, wherein said second vane is located in said zone on the inlet side of said first vanes.

* * * * *